United States Patent [19]

Kanoh et al.

[11] Patent Number: 4,711,289

[45] Date of Patent: Dec. 8, 1987

[54] CASTING METHOD AND APPARATUS

[75] Inventors: Kunihiko Kanoh, Togura; Kanji Matsuki; Kazuhisa Ohta, both of Nagano; Tadaomi Sunohara, Kohshoku, all of Japan

[73] Assignee: Morikawa Sangyo Kabushiki Kaisha, Nagano, Japan

[21] Appl. No.: 22,764

[22] Filed: Mar. 6, 1987

[30] Foreign Application Priority Data

Mar. 14, 1986 [JP] Japan ..... 61-56272
Apr. 2, 1986 [JP] Japan ..... 61-49276

[51] Int. Cl.[4] ..... B22C 9/04

[52] U.S. Cl. ..... 164/34; 164/246; 164/410; 164/324

[58] Field of Search ..... 164/34, 35, 246, 410, 164/516, 44, 324

[56] References Cited

FOREIGN PATENT DOCUMENTS 57-85637 5/1982 Japan ..... 164/35

*Primary Examiner*—Kuang Y. Lin
*Attorney, Agent, or Firm*—Price, Heneveld, Cooper, DeWitt & Litton

[57] ABSTRACT

A flask is filled with a heat resistant filling material, such as sand, to embed therein a pattern of the type which melts down and generates combustible gas when it is heated, a runner connected to the pattern and provided with a sprue and a hollow venting device having an open upper end and a sidewall provided with at least one vent opening. A molten metal is poured into the sprue. The molten metal reaching the pattern through the runner heats the pattern and causes it to melt down and generate gas. The molten metal occupies a cavity formed by the meltdown of the pattern and drives out the gas into the venting device through the filling material and the vent opening. The gas is burned at the upper end of the venting device. Disclosed also is an apparatus which can be used for carrying out the method as hereinabove summarized. The apparatus is useful for either a batch or a continuous type of casting operation.

8 Claims, 5 Drawing Figures

CASTING METHOD AND APPARATUS

BACKGROUND OF THE INVENTION

1. Field of the Invention

This invention relates to a method and an apparatus for manufacturing castings. More particularly, it relates to a casting method which employs a pattern of the meltaway type and an apparatus which is used for carrying it out.

2. Description of the Prior Art

There are known a variety of casting methods of the nature to which this invention pertains. Some of the known methods will be described, though not shown in the accompanying drawings.

According to a first method, a pattern of the meltaway type which is formed from a polystyrene foam or the like is embedded in a filling material, such as casting sand, in a metallic molding flask. A runner has a lower end connected to the pattern and an upper end provided with a sprue. The flask has a sidewall provided with a multiplicity of vent holes which are so small as to allow the passage of only gas, while virtually no filling material can pass therethrough. The molten metal which is supplied through the sprue and the runner heats the pattern and melts it away. The meltaway of the pattern forms a cavity in which the molten metal is molded. The gas rising from the melted pattern flows through the interstices of the particles of the filling material and leaves the flask through the vent holes.

According to a second method, a flask of the type which is used by the first method is placed in an outer housing which is larger than the flask. The housing has an upper end joined to the upper end of the flask in a gas-tight fashion and defines a gas chamber surrounding the flask. A suction pump is connected to the gas chamber. The gas rising from the melted pattern and leaving the flask, as hereinbefore stated in connection with the first method, enters the gas chamber and is, then, drawn out by the pump.

A third method employs a flask not having any vent hole and a gastight tubular venting device embedded in the filling material and having a sidewall provided with a multiplicity of vent holes. The venting device has an upper end connected to a suction pump. The gas rising from the pattern which has been melted away by the molten metal flows through the interstices of the particles of the filling material, enters the venting device through its vent holes and is drawn out by the pump.

All of the methods which have hereinabove been described have a number of drawbacks. The drawbacks of the first method are due to the fact that no positive means is used for removing the gas, but that the gas is merely allowed to flow out. The gas can be removed only slowly. Therefore, its pressure is likely to cause the molten metal to flow back through the runner and blow out at the sprue and result in the failure to be properly molded. The pressure of the gas is also likely to break or deform the wall of the cavity and thereby make it difficult to manufacture any sound product. Moreover, the gas leaving the flask contaminates its environment.

The second method is uneconomical. It requires a suction pump having a large capacity. It also requires a member for connecting the pump and the gas chamber. This method is difficult to carry out if a plurality of flasks are disposed in a circular array so as to be rotatable in a horizontal plane for receiving a molten charge at one station and delivering a cast product at another station. It is a troublesome job to disconnect the pump from the gas chamber of one flask and connect it to the gas chamber of another flask.

The third method also requires a suction pump having a large capacity and a member for connecting it to the venting device. It is difficult to carry out if a plurality of flasks are employed as hereinabove stated in connection with the second method.

SUMMARY OF THE INVENTION

Under these circumstances, it is an object of this invention to provide a casting method which does not require any pump for removing gas and an apparatus which is useful for carrying it out.

It is another object of this invention to provide a casting method which does not require any member for connecting a suction pump to a venting device or a gas chamber and an apparatus which is useful for carrying it out.

It is still another object of this invention to provide a casting method which can effectively remove the gas rising from a pattern which has been melted away and prevent the back flow of the molten metal and the destruction or deformation of the wall of a mold cavity by the molten metal to thereby manufacture a sound product and an apparatus which is useful for carrying it out.

It is a further object of this invention to provide a casting method which can prevent the contamination of a working environment by the gas rising from a pattern which has been melted away and an apparatus which is useful for carrying it out.

It is a still further object of this invention to provide a casting method which enables the continuous manufacture of a plurality of cast products and an apparatus which is useful for carrying it out.

These objects are attained by a casting method comprising filling a flask with a heat resistant filling material so that it may cover a pattern formed from a material which melts down and generates combustible gas when it is heated, a runner extending from a sprue to the pattern and a hollow venting device having an open upper end located above the filling material and a sidewall provided with vent holes; pouring a molten metal through the sprue and the runner so that it may melt away the pattern, replace it and drive out the combustible gas into the venting device through its vent holes; and burning the gas adjacent to the upper end of the venting device.

The objects are also attained by a casting apparatus comprising a flask which is filled with a heat resistant filling material; a pattern formed from a material which melts down and generates combustible gas when it is heated; a runner extending from a sprue to the pattern; a hollow venting device having an open upper end located above the filling material and a sidewall provided with a plurality of vent holes, the pattern, the runner and the venting device being embedded in the filling material; and a device provided near the upper end of the venting device for igniting the combustible gas which is generated by the pattern when it is melted down by a molten metal.

These and other objects and features of this invention will become more apparent from the following description and the accompanying drawings.

DETAILED DESCRIPTION OF THE INVENTION

Figure 1:
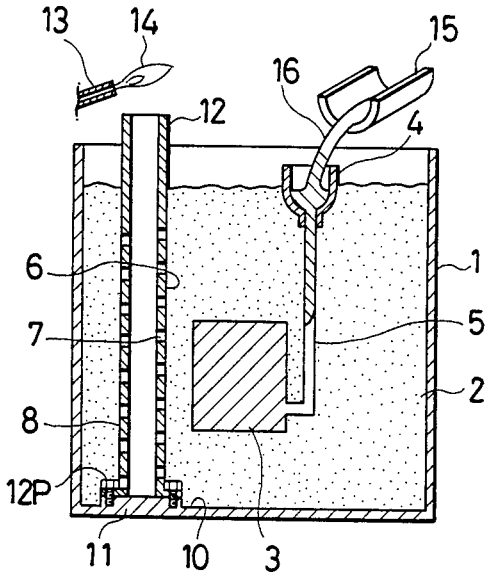
FIG. 1 is a schematic vertical sectional view of an apparatus embodying this invention and shows one of the steps constituting a method embodying this invention.

Referring to FIG. 1, a casting apparatus embodying this invention includes a flask 1 in the form of a box made of iron or other metal. The flask 1 is filled with a heat resistant particulate filling material 2, such as sand or ceramic, steel or refractory particles. A pattern 3 of the meltaway type is embedded in the filling material 2. The pattern 3 may, for example, be formed from a polystyrene foam. A runner 5 is embedded in the filling material 2 and has an upper end provided with a sprue 4 and a lower end connected to the pattern 3. The sprue 4 may, for example, be a molded ceramic product or a shell molded product. The runner 5 may be formed from the same material as that from which the pattern 3 is formed, so that it may melt away when it is heated. The runner 5 may form an integral part of the pattern 3 or may alternatively be a separate part joined to the pattern 3 by an adhesive or otherwise. An upstanding hollow venting device 8 is embedded in the filling material 2 and has a sidewall 6 provided with a plurality of vent holes 7.

Figure 3:
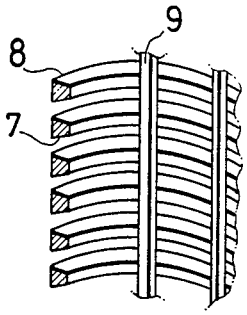
FIG. 3 is a fragmentary enlarged perspective view of a venting device.
Figure 4:
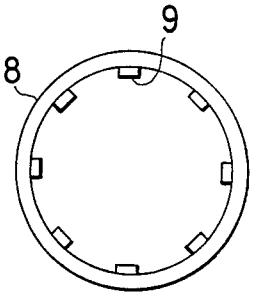
FIG. 4 is a top plan view of the venting device.

The venting device 8 may be formed from any of various kinds of materials having a multiplicity of openings, such as a wire net, punched metal or steel wool. It may, for example, comprise a spiral pipe filter (FIGS. 3 and 4) to which a pipe 12 (FIG. 1) which is of the same diameter with the spiral pipe is welded. The spiral pipe may, for example, be made of steel. The vent holes 7 are defined by a single spiral opening. The spiral pipe can withstand a high external pressure. The spiral pipe filter includes a plurality of vertically extending reinforcing members 9 joined to its inner surface. The vent opening 7 has a width which gradually decreases from the inner surface of the spiral pipe to its outer surface, as shown in FIG. 3, so that it may not easily be clogged with the filling material 2. The vent opening 7 is, therefore, easy to clean.

The venting device 8 has a lower end secured by bolts 12 to a base 11 provided on the inner bottom surface 10 of the flask 1. Alternatively, a dovetail joint may be employed for securing the lower end of the venting device 8 to the base 11, though not shown. It is also useful to employ a dovetail joint or any other type of guiderail so that the venting device 8 may be horizontally movable to a position which suits the dimensions of the pattern 3. The venting device 8 has an open upper end located above the surface of the filling material 2.

Figure 2:
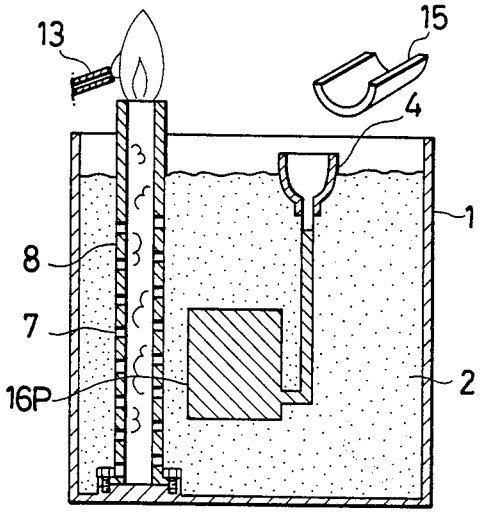
FIG. 2 is a view similar to FIG. 1, but showing another step of the method.

The apparatus further includes a device 13 provided near the upper end of the venting device 8 for igniting the gas leaving it. Any type of device can be used if it can ignite the combustible gas which is generated by the pattern 3. The igniting device 13 may, for example, comprise a burner which is fired with town or propane gas. The igniting device 13 maintains a pilot flame 14. A spout is shown at 15 for pouring a molten metal 16 from a melting furnace into the sprue 4 so that a product 16P may eventually be molded, as shown in FIG. 2.

Referring to the casting operation, the flask 1 in which the venting device 8 has been mounted is partly filled with the filling material 2, such as molding sand, and the pattern 3 is placed on the filling material 2 adjacent to the venting device 8. If the runner 5 is a separate part from the pattern 3, its lower end is joined to the pattern 3. Then, the filling material 2 is added until it covers the whole pattern 3, a part of the sprue 4 and the greater part of the venting device 8, as shown in FIG. 1. The filling material 2 is shaken by a device not shown. Then, the igniting device 13 is fired to provide the pilot flame 14 and the molten metal 16 is poured into the sprue 4. The molten metal 16 which reaches the pattern 3 through the runner 5 heats it and decomposes it into gas. The molten metal 16 fills the cavity which has been formed by the decomposition of the pattern 3, and is molded therein into a particular shape. The gas flows through the interstices of the particles of the filling material 2 and enters the spiral pipe filter defining the venting device 8 through its vent opening 7. The gas rises through the venting device 8 and is ignited by the pilot flame 14 upon leaving the upper end of the venting device 8. As the gas is burned, the venting device 8 has a lower gas density in its lower portion and the suction of gas into the venting device 8 and its upward flow are promoted by the chimney effect. It is possible to manufacture every product within substantially the same length of time if all the products are of the same size and shape.

Figure 5:
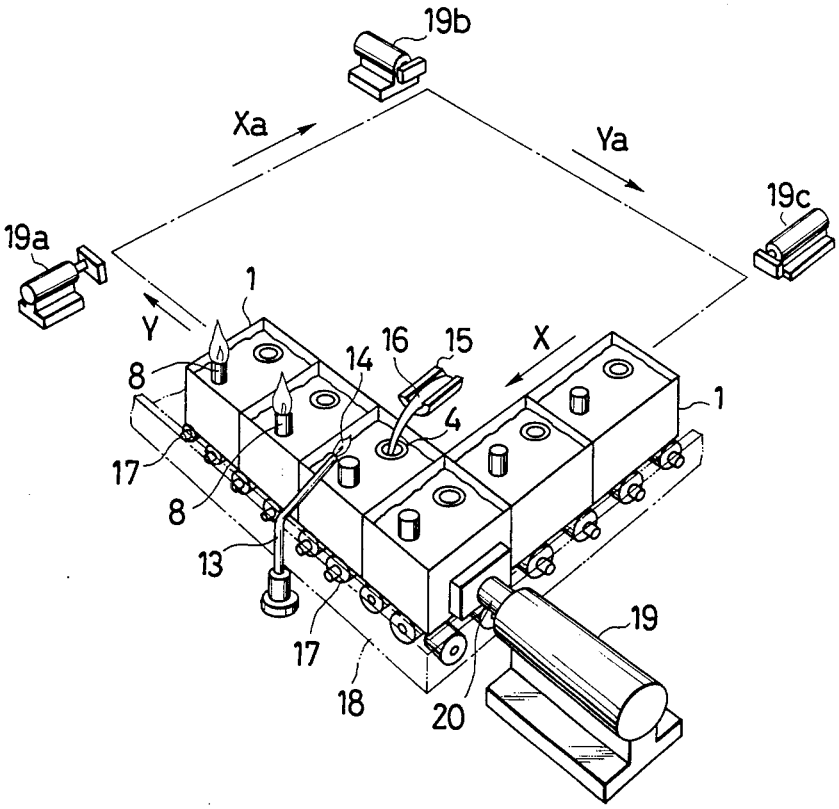
FIG. 5 is a schematic perspective view showing another embodiment of this invention.

Attention is now directed to FIG. 5 showing by way of example a continuous manufacturing system which comprises a plurality of apparatus embodying this invention. Each apparatus is constructed as hereinabove described and includes a flask 1. The flasks 1 are disposed in a square array and contact one another. The flasks 1 are supported on a plurality of rollers 17 which are arranged in a square array and are rotatably supported on a square roller support 18. The rollers 17 include two sets of rollers provided at each of the four corners of the square array and lying at right angles to each other, though they are not shown in detail. The two sets of rollers 17 are alternately vertically movable to enable each flask 1 to change its direction of travel at each corner of the square array, for example, from the direction indicated by an arrow X to the direction indicated by an arrow Y. The spout 15 of a melting furnace and an igniting device 13 are provided by way of example for pouring the molten metal 16 into the flask 1 immediately preceding the flask 1 located at the corner between the X and Y axes of the square array and for burning the gas leaving it, respectively. Four fluid pressure cylinders 19, 19*a*, 19*b* and 19*c* are provided adjacent to the four corners, respectively, of the square array. They may, for example, be hydraulic cylinders. Each cylinder includes a piston rod as shown at 20 by way of example.

In operation, the flask 1 which has arrived at the corner between the X and Y axes is pushed by the cylinder 19 and moved in the direction of the arrow Y by the distance which is equal to the length or width of the flask 1. The molten metal 16 is poured from the spout 15 to the flask 1 through the sprue 4. The gas leaving the upper end of the venting device 8 is ignited by the pilot flame 14. When a predetermined amount of molten metal 16 has been poured into the flask 1, it is moved again by the cylinder 19 in the direction of the arrow Y by the same distance. All of the flasks 1 are intermittently moved along the square array by the cylinders, as hereinabove described, and various kinds of jobs including the removal of the molded product, the positioning of a new pattern 3 and a new runner and the supply of the filling material are repeatedly carried out one after another at the respective stations not shown so that the flasks 1 may be used for the continuous manufacture of the molded products. The other cylinders 19*a* to 19*c* are provided for changing the direction of flask travel from the Y axis to the Xa axis, from the Xa axis to the Ya axis and from the Ya axis to the X axis, respectively, as is obvious from FIG. 5.

This invention has a number of advantages which can be summarized as will hereinafter be set forth by way of example, though they may already be apparent from the foregoing description. The method and apparatus of this invention are economical. No pump for drawing gas out of the flask is required, as the igniting device is provided for burning the gas leaving the upper end of the venting device which is embedded in the filling material adjacent to the pattern. As no pump is necessary, no member for connecting it to the flask is, of course, required, either. The gas which is generated by the pattern when it melts down can be removed effectively by the chimney effect, insofar as it is burned at the upper end of the venting device. According to this invention, there is no back flow of the molten metal resulting from the inefficient removal of gas, nor is there any destruction or deformation of the wall of the mold cavity. It is always possible to manufacture sound products. The combustion of the gas at the outlet of the venting device protects the working environment against pollution. Moreover, the method and apparatus of this invention are easily applicable to the continuous manufacture of products, as a plurality of flasks can be arranged in an array in which they are easily movable one after another.

What is claimed is:

1. A casting method comprising:

filling a flask with a heat resistant filling material to embed therein a pattern of the type which melts down and generates combustible gas when it is heated, a runner connected to said pattern and provided with a sprue and a hollow venting device having an open upper end and a sidewall provided with at least one vent opening;

pouring a molten metal into said sprue so that said molten metal reaching said pattern through said runner may heat said pattern and cause it to melt down and generate gas, may occupy a cavity formed by the meltdown of said pattern and may drive out said gas into said venting device through said filling material and said vent opening; and burning said gas at said upper end of said venting device.

2. A method as set forth in claim 1, wherein said burning is initiated by an igniting device.

3. A casting apparatus comprising:

at least one flask filled with a heat resistant filling material;

a pattern embedded in said filling material and forced from a material which melts down and generates combustible gas when it is heated;

a runner connected to said pattern and provided with a sprue;

a vertically disposed hollow venting device embedded in said filling material and having an open upper end located above said filling material and a sidewall provided with at least one vent opening; and a device provided adjacent to said upper end of said venting device for igniting said gas.

4. An apparatus as set forth in claim 3, wherein said venting device comprises a spiral pipe filter having a sidewall provided with said vent opening and an ordinary pipe connected to said filter and having an upper end defining said upper end of said venting device.

5. An apparatus as set forth in claim 3, wherein a plurality of flasks are arranged in an endless array movably one after another.

6. An apparatus as set forth in claim 5, wherein said flasks are supported on an endlessly moving system.

7. An apparatus as set forth in claim 6, wherein said system comprises a plurality of rollers disposed in an endless array and carrying said flasks thereon and is provided with a plurality of fluid pressure cylinders for pushing said flasks one after another along said array of said rollers.

8. An apparatus as set forth in claim 7, wherein said array is a square one and each of said cylinders is located adjacent to one of the four corners of said square array.

* * * * *

UNITED STATES PATENT AND TRADEMARK OFFICE

CERTIFICATE OF CORRECTION

PATENT NO. : 4,711,289

DATED : December 8, 1987

INVENTOR(S) : Kunihiko Kanoh et al.

It is certified that error appears in the above-identified patent and that said Letters Patent is hereby corrected as shown below:

Column 6, line 17:
"forced" should be --formed--.

Signed and Sealed this

Second Day of August, 1988

*Attest:*

*Attesting Officer*

DONALD J. QUIGG

*Commissioner of Patents and Trademarks*